United States Patent [19]

McGowan

[11] 4,352,666

[45] Oct. 5, 1982

[54] MARINE PROPULSION DEVICE WITH TRIM SENSITIVE MOVABLE TRIM TAB

[75] Inventor: Philip J. McGowan, Waukegan, Ill.

[73] Assignee: Outboard Marine Corporation, Waukegan, Ill.

[21] Appl. No.: 176,864

[22] Filed: Aug. 11, 1980

[51] Int. Cl.[3] ..... B63H 25/48

[52] U.S. Cl. ..... 440/53; 440/66; 440/51; 440/71; 114/144 R; 114/162

[58] Field of Search ..... 440/51, 52, 53, 66, 440/62, 66, 900; 114/144 R, 145 R, 145 A, 146, 149, 152, 162–165, 167

[56] References Cited

U.S. PATENT DOCUMENTS

| | | | |
|---|---|---|---|
| 2,993,464 | 7/1961 | Conover | 440/51 |
| 3,149,605 | 9/1964 | Broadwell | 440/53 |
| 3,183,880 | 5/1965 | Shimanckas | 440/52 |
| 3,799,103 | 3/1974 | Granholm | 440/66 |
| 3,817,202 | 6/1974 | Holtermann | 440/66 |
| 3,943,878 | 3/1976 | Kirkwood | 440/51 |

*Primary Examiner*—Trygve M. Blix
*Assistant Examiner*—D. W. Keen
*Attorney, Agent, or Firm*—Michael, Best & Friedrich

[57] ABSTRACT

Disclosed herein is an outboard motor comprising a propulsion unit including a rotatably mounted propeller, structure adapted to be fixedly connected to a boat transom and connected to the propulsion unit for mounting of the propulsion unit for pivotal movement about an axis which is horizontal when the mounting structure is boat mounted, a trim tab mounted on the propulsion unit for pivotal movement about an axis transverse to the horizontal axis, and a linkage for displacing the trim tab about the transverse axis in response to movement of the propulsion unit about the horizontal axis.

9 Claims, 3 Drawing Figures

MARINE PROPULSION DEVICE WITH TRIM SENSITIVE MOVABLE TRIM TAB

BACKGROUND OF THE INVENTION

The invention relates generally to marine propulsion devices such as outboard motors and stern drive units, and more particularly, to marine propulsion devices including trim tabs or exhaust snouts arranged to counterbalance steering torque, include steering torque generated incidence to rotation of a propeller in the water.

Such trim tabs have been known in the past and it has also been known to provide for adjustment of the position of such trim tabs relative to the marine propulsion device.

Attention is directed to the following U.S. Pat. Nos.:

Conover—2,993,464—July 25, 1961

Shimanckas—3,000,183—May 19, 1965

Holtermann—3,357,419—Nov. 3,1970

Granholm—3,799,103—Mar. 26, 1974

Holtermann—3,817,202—June 18, 1974

Attention is also directed to Canadian Pat. No. 687,868 issued June 2, 1964.

SUMMARY OF THE INVENTION

The invention provides an outboard motor comprising a propulsion unit including a rotatably mounted propeller, mounting means adapted to be fixedly connected to a boat transom and connected to the propulsion unit for mounting of the propulsion unit for pivotal movement about an axis which is horizontal when the mounting means is boat mounted, a trim tab, means mounting the trim tab on the propulsion unit for pivotal movement about an axis transverse to the horizontal axis, and linkage means for displacing the trim tab about the transverse axis in response to movement of the propulsion unit about the horizontal axis.

In one embodiment in accordance with the invention, the propulsion unit mounting means comprises a first bracket adapted to be fixedly mounted to the transom of a boat, a second bracket connected to the first bracket for tilting movement about the horizontal axis, and means connecting the propulsion unit to the first bracket for common movement with the second bracket about the horizontal axis and relative to a lowermost position and for steering movement of the propulsion unit relative to the second bracket about a steering axis transverse to the horizontal axis. In addition, the linkage means for displacing the trim tab includes a member pivotally mounted on the second bracket, interengaging means on the member and on the first bracket for pivoting the member in response to movement of the second bracket about the horizontal axis, flexible cable means connecting the member and the trim tab for displacing the trim tab in response to displacement of the member, and means biasing the linkage means so as to retain engagement of the interengaging means and thereby to locate the trim tab in accordance with the position of the propulsion unit.

Other features and advantages of the embodiments of the invention will become known by reference to the following general description, claims and appended drawings.

IN THE DRAWINGS

Figure 1:
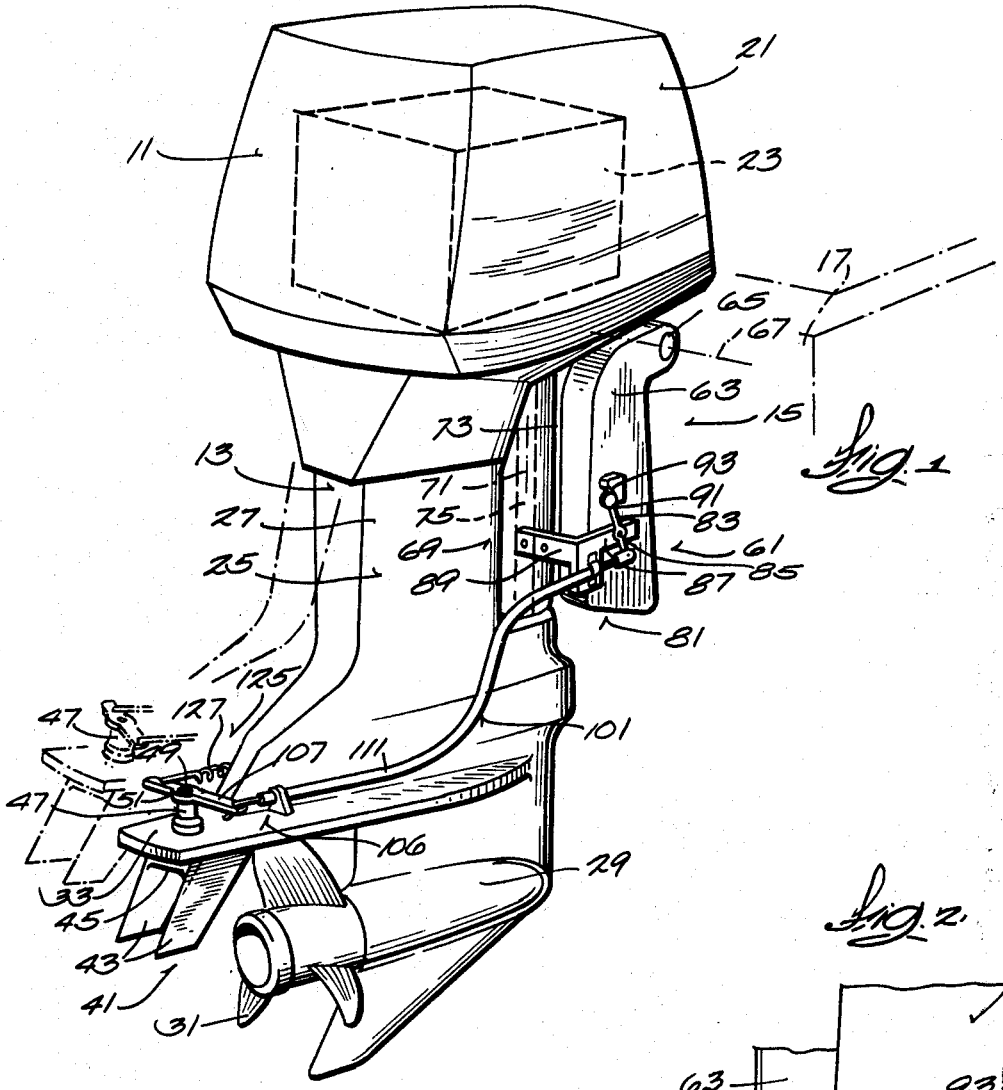
FIG. 1 is a perspective view of an outboard motor incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device in the form of a outboard motor 11 including a propulsion unit 13 and means 15 adapted to be fixedly connected to the transom 17 of a boat for mounting the propulsion unit 13 for pivotal steering movement and for pivotal tilting movement about an axis which is horizontal when the motor is boat mounted.

The propulsion unit 13 includes a power head 21 including an internal combustion engine 23, together with a lower unit 25 including a drive shaft housing 27 affixed, at its upper end, to the power head 21 and affixed, at its lower end, to a gear box or case 29 supporting a rotatably mounted propeller 31 which is driven by the internal combustion engine 23. The lower unit 25 also is provided with a cavitation plate 33 located approximately at the connection of the drive shaft housing 27 to the gear case 29.

Carried by the cavitation plate 33 is a trim tab 41 which, in the disclosed construction, includes two trim tab elements or fins 43 which can be of any suitable shape and which, at their upper ends, extend fixedly from a common horizontally extending member 45. If desired the trim tab 41 can employ only a single trim tab element or fin 43. Extending upwardly from the horizontal member 45 and through a bearing or bushing 47 carried by the cavitation plate 33 is a stud 49 which provides for pivotal movement of the trim tab about a generally vertical axis and relative to a standard or reference position. Any suitable means, such as a snap ring 51, can be employed to retain the stud 49 in the bearing 47 in the cavitation plate 33.

As a consequence, the trim tab 41 is movable between a normal running reference position and a maximum counter-balancing position as will be referred to hereinafter.

The propulsion unit mounting means 15 includes a first or transom bracket 61 which is adapted to be fixedly mounted on the boat transom 17, together with a second or swivel bracket 63 which is connected to the first bracket 61 by suitable means which can be in the form of a tilt tube 65 providing for pivotal displacement of the second or swivel bracket 63 relative to the first or transom bracket 61 about an axis 67 which is horizontal when the first transom bracket 61 is boat mounted.

The means 15 for mounting the propulsion unit 13 also includes means 69 for connecting the propulsion unit 13 to the second or swivel bracket 63 for pivotal movement about a steering axis 71 which is transverse to the horizontal axis 67. While various arrangements can be employed, in the disclosed construction, such means 69 comprises formation of the second swivel bracket 63 with a vertically extending leg 73 having therein a bore and a king pin 75 which extends in the bore and which is fixedly connected at its upper and lower ends to the drive shaft housing 27.

As a consequence of the above disclosed mounting, the propulsion unit 13 is steerable about the axis 71 relative to the second or swivel bracket 63 and also relative to the first or transom bracket 61 and to the boat transom 17 and it tiltable about the horizontal axis 67 in common with the second or swivel bracket 63 relative to the first or transom bracket 61 and to the transom 17 between a lowermost position and a fully tilted or raised position. The lower portion of the range of movement between the lowermost position and the fully tilted or raised position has sometimes been referred to as a trim range while the upper or major portion of the full range of pivotal movement has been referred to as a tilt range.

Various means well known in the art can be employed for displacing the second or swivel bracket 63 and connected the propulsion unit 13 about the axis 67 and relative to the first or transom bracket 61. For instance, a hydraulic cylinder-piston assembly (not shown) could be employed.

In the past, trim tabs have normally been fixed in running position so as to overcome any steering torque present when the propulsion unit 13 was in the lowermost position. Upward displacement of the propulsion unit 13 from the lowermost position and through the trim range results in generation of a torque condition which progressively differs from the torque occurring when the propulsion unit is in the lowermost position.

Means 81 are also provided in the outboard motor 11 for displacing or adjusting the trim tab 41 from the usual running or reference position through a range of positions to a full correction position or full counter balancing position as the propulsion unit 13 is tilted upwardly so as thereby to counter or balance the progressively differing torque occurring incident to such upward movement.

While various arrangement can be provided, in the disclosed construction, such means 81 comprises a member 83 movable mounted on one of the swivel or second bracket 63 and the first or transom bracket 61, which member 83 is engageable with means on the other of the first and second brackets 61 and 63 so as to cause movement of the member 83 in response to movement of the second or swivel bracket 63 relative to the first or transom bracket about the horizontal axis 67.

In the specifically disclosed construction, the member comprises a lever which is pivotally mounted intermediate its ends at 85 on the forwardly extending leg 87 of an L shaped strut 89 extending fixedly from the second or swivel bracket 63. At the upper end thereof, the lever 83 includes a follower 91 which is engageable with a concave cam surface 93 fixed on the side of the first or transom bracket 61. Accordingly, relative movement of the second or swivel bracket 63 relative to the first or transom bracket 61 causes pivotal movement of the lever 83.

The trim tab displacement or adjustment means 81 also includes a flexible cable 101 connecting the lever 83 and the trim tab 41. While various arrangements can be employed, in the disclosed construction, the cable 101 comprises an inner core 103 which, at its forward end, is pivotally connected, by any suitable means, to the lower end of the lever 83 and which, and it rearward end, is pivotally connected, by any suitable means, with one end of a cross bar 107 extending fixedly from the trim tab stud 49.

The cable 101 also includes an outer sheath 111 which encloses the inner core 103 and which, at its forward end, is fixed at 104 to the leg 87 of the strut 89 and which at its rearward end, is fixed at 106 to the cavitation plate 33.

Means 125 are also provided for biasing the follower 91 into engagement with the cam surface 93 and and whereby also to bias the trim tab 41 toward the full counterbalancing position. While various arrangements can be employed, in the illustrated construction, such means 125 comprises a helical tension spring 127 which is connected, at its rearward end, to the other end of cross bar 107 fixed to the trim tab stud 40 and which, at its forward end, is anchored at 129 by any suitable means to the cavitation plate 33.

Figure 2:
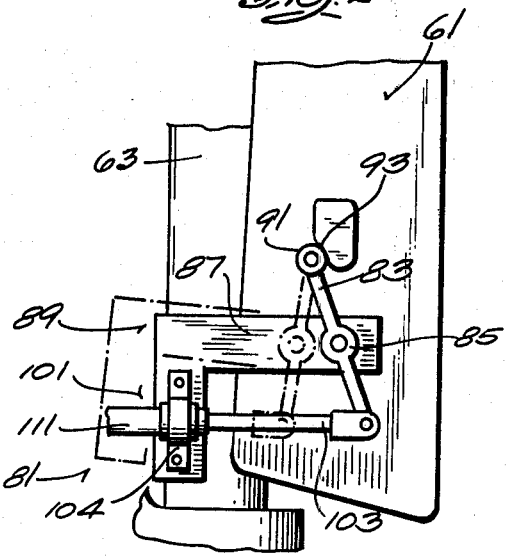
FIG. 2 is a fragmentary enlarged view of a portion of the outboard motor shown in FIG. 1, illustrating various of the components in greater detail.
Figure 3:
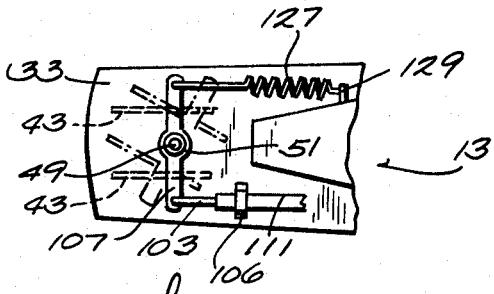
FIG. 3 is a fragmentary view of another portion of the outboard motor shown in FIG. 1, illustrating various of the components in greater detail.

As a consequence, when the second or swivel bracket 63 (together with the propulsion unit 13) is in the lowermost position, the spring 127 biases the lever 83 so that the follower 91 is engaged with the cam surface 93 and thereby locates the trim tab 41 in the normal running or reference position. If the propulsion unit 13 is trimmed upwardly, such movement of the second or swivel bracket 63 relative to the first or transom bracket 61 permits the lever 83 to rotate in a clockwise direction, as shown in FIG. 2 under the influence of the spring 127, thereby permitting rearward displacement of the inner core 103 relative to the outer sheath 111, and thereby effecting rotation of the trim tab stud 49 in a clockwise direction, as seen from above in FIG. 1, so as to displace the trim tab 41 toward the full counter balancing position.

Return of the second or swivel bracket 63 toward the first or transom bracket 61 serves to displace the inner core 103 forwardly and to thereby return the trim tab 41 to the normal running or reference position against the action of the spring 127.

The invention is equally applicable to the tiltable and steerable propulsion unit or stern leg of a stern drive unit.

Various of the features of the invention are set forth in the following claims.

I claim:

1. A marine propulsion device comprising a propulsion unit including a rotatably mounted propeller, mounting means adapted to be fixedly connected to a boat transom and connected to said propulsion unit for mounting of said propulsion unit for pivotal movement about an axis which is horizontal when said mounting means is boat mounted, a trim tab, means mounting said trim tab on said propulsion unit for pivotal movement about an axis transverse to said horizontal axis, and linkage means for displacing said trim tab about said transverse axis in response to movement of said propulsion unit about said horizontal axis.

2. A marine propulsion device comprising a propulsion unit including a rotatably mounted propeller, a first bracket adapted to be fixedly mounted to the transom of a boat, a second bracket connected to said first bracket for tilting movement about an axis which is horizontal when said mounting means is boat mounted, means connecting said propulsion unit to said second bracket for common movement with said second bracket about the horizontal axis and relative to a lowermost position and for steering movement of said propulsion unit relative to said second bracket about a steering axis transverse to said horizontal axis, a trim tab, means mounting said trim tab on said propulsion unit for pivotal movement about an axis transverse to said horizontal axis, a member pivotally mounted on one of said first and second brackets, interengaging means on said member and on the other of said first and second brackets for pivoting said member in response to movement of said second bracket about said horizontal axis, and flexible cable means connecting said member and said trim tab for displacing said trim tab in response to displacement of said member occurring in response to movement of said propulsion unit about said horizontal axis.

3. A marine propulsion device in accordance with claim 2 wherein said linkage means further includes means biasing said linkage means so as to retain engagement of said interengaging means and thereby to locate said trim tab in accordance with the position of the propulsion unit.

4. A marine propulsion device in accordance with claim 3 wherein said biasing means comprises a tension spring.

5. A marine propulsion device in accordance with claim 4 wherein said propulsion unit includes a cavitation plate and wherein said trim tab is pivotally mounted in said cavitation plate.

6. A marine propulsion device in accordance with claim 5 wherein said trim tab includes two laterally spaced trim tab fins.

7. A marine propulsion device in accordance with claim 6 wherein said trim tab includes a cross bar having opposed ends on opposite sides of the pivotal axis of said trim tab and wherein one of said ends is connected to said flexible cable means and wherein the other of said ends is connected to said tension spring.

8. A marine propulsion device comprising a propulsion unit including a rotatably mounted propeller, a first bracket adapted to be fixedly mounted to the transom of a boat, a second bracket connected to said first bracket for tilting movement about an axis which is horizontal when said mounting means is boat mounted, means connecting said propulsion unit to said second bracket for common movement with said second bracket about the horizontal axis and relative to a lowermost position and for steering movement of said propulsion unit relative to said second bracket about a steering axis transverse to said horizontal axis, a trim tab, means mounting said trim tab on said propulsion unit for pivotal movement about an axis transverse to said horizontal axis, a member pivotally mounted on said second bracket, interengaging means on said member and on said first bracket for pivoting said member in response to movement of said second bracket about said horizontal axis, flexible cable means connecting said member and said trim tab for displacing said trim tab in response to displacement of said member occurring in response to movement of said propulsion unit about said horizontal axis, and means biasing said linkage means so as to retain engagement of said interengaging means and so as to locate said trim tab in accordance with the position of the propulsion unit.

9. A marine propulsion device in accordance with claim 8 wherein said member is pivotally mounted intermediate the ends thereof and wherein said interengaging means comprises a follower on one of said ends of said member and a cam surface on said first bracket, and wherein said flexible cable is connected to the other of said ends of said member.

* * * * *